United States Patent [19]

Fuchs

[11] 4,188,723

[45] Feb. 19, 1980

[54] WINDOW PUTTY REMOVAL APPARATUS

[76] Inventor: Richard W. Fuchs, 17 Deerfield La., Simsbury, Conn. 06070

[21] Appl. No.: 822,051

[22] Filed: Aug. 5, 1977

[51] Int. Cl.[2] ..... B26B 7/00

[52] U.S. Cl. ..... 30/276; 30/286; 30/290; 30/296 R; 144/144.5 GT; 409/178; 409/182

[58] Field of Search .... 144/144 R, 134 D, 144.5 GT, 144/253 R, 253 D; 30/286, 292, 289, 290, 276, 296 R, 296 A; 33/185 R

[56] References Cited

U.S. PATENT DOCUMENTS

| | | | |
|---|---|---|---|
| 612,120 | 10/1898 | Pierce | 30/292 |
| 1,723,106 | 8/1929 | Wiglenda | 144/144.5 GT UX |
| 1,792,415 | 2/1931 | Dean | 30/286 X |
| 2,930,290 | 3/1960 | Cooke | 90/12 R |
| 2,957,507 | 10/1960 | Vargo | 30/286 |
| 3,010,352 | 11/1961 | Dunlap | 30/276 X |

FOREIGN PATENT DOCUMENTS

| | | | |
|---|---|---|---|
| 29782 | of 1910 | United Kingdom | 144/144 R |

*Primary Examiner*—Othell M. Simpson
*Assistant Examiner*—J. T. Zatarga
*Attorney, Agent, or Firm*—Prutzman, Kalb, Chilton & Alix

[57] ABSTRACT

A window putty removal apparatus is provided which can be conveniently utilized with various window sizes and configurations without the necessity of removing the window sash from its frame. The apparatus includes an elongated flexible guide strip of variable effective length so that it can be applied to the stiles and muntins of different sized windows without removing the windows and a plurality of manual fasteners for securing the guide strip to the window sash adjacent to a strip of putty to be removed. The apparatus also includes a cutting member having a cutter mounted on a shank driven by a rotary power tool and an adapter element rotatably mounted on the shank and cooperable with the guide strip for guiding the cutter through the strip of putty as the power tool is moved longitudinally relative to the guide strip to remove the putty from the window.

1 Claim, 3 Drawing Figures

WINDOW PUTTY REMOVAL APPARATUS

The present invention relates to an apparatus for removing putty from a window sash and, more particularly, to a window putty removal kit which enables glazing putty or other similar material to be rapidly and accurately removed from a window sash without damage to the window sash.

The difficulty of removing old, dried out glazing putty from a window sash to allow for replacement of a glass pane and/or the putty is well known. When the removal is accomplished by manual scraping techniques using heat and hand tools, it is a long, tedious job. Although alternative techniques have been proposed, none has found widespread acceptance because of the expense and inconvenience in comparison with the long established practice of scraping the putty by hand.

For example, to eliminate the difficult manual task of putty removal, commercial putty removers have utilized a heater to soften the putty which is then scraped off manually with a putty knife or wood chisel. Typically, the heater consumes a high amount of energy, e.g., 1000 watts, requires an expensive power cord, and generates a relatively high temperature, e.g., 1500° F. Thus, the heater is expensive to operate and must be handled carefully to avoid possible injury. Also, at low ambient temperatures, the heater is substantially less effective and the putty removal is extremely difficult. Often, the window sash may be charred and the glass pane cracked by the heat. The resulting char on the wood and painted surfaces must be removed before new putty is applied. Thereafter, the sash must be repainted. Moreover, if the glass is completely locked in wood, e.g., in the case of a garage door, the heat softening technique is useless.

Further, it has been proposed, as shown in Cooke U.S. Pat. No. 2,930,290, to employ a putty removal technique in which a rigid guide rail is secured to a window sash to guide a cutter driven by a rotary power tool through a strip of putty to be removed from the sash. An adapter is mounted for rotation with the cutter and serves to guide the power tool and cutter longitudinally along the guide rail to remove the putty from the window sash. However, this previous putty removal apparatus is quite limited in application and has serious drawbacks. The rigid guide rail is fixed in length and cannot be adapted to different window sizes. It is necessary to remove the window sash from its frame to allow the guide rail to be mounted adjacent to the different vertical and horizontal strips of putty along the stiles and muntins of the sash. In addition, the connection of the adapter to rotate with the cutter creates a tendency for the adapter to roll along the guide rail as the cutter is rotated by the power tool. Unless care is used, it is easy to lose control of the power tool and to damage the window sash and/or glass pane with the cutter.

The present invention is intended to provide an improved putty removal apparatus which is readily used with windows of different sizes or configurations without the necessity of removing the window sash from its frame. A purpose of the invention is to facilitate putty removal along the stiles and muntins of the window with the sash in place. It is also intended to provide a safe and efficient putty removal technique in which the likelihood of damage to the window sash and glass pane is substantially reduced.

Another objective of the invention is to provide a conveniently operable putty removal kit which can be used with a conventional power drill or hand grinder which has a relatively small power requirement. In addition, a purpose of the kit is to allow substantially all of the putty to be removed by operation of the power drill or head grinder and to minimize the amount of manual scraping required.

The present invention achieves the above objectives in an improved apparatus for removing putty from a window sash comprising an elongated, flexible guide strip adapted to be mounted on the window sash adjacent to a strip of putty to be removed, means for fastening the guide strip to the window sash adjacent to the strip of putty, a cutting member including a shank to be driven by a power tool and a cutter on the shank for engaging the putty, and an adapter element adapted to be rotatably mounted on the shank of the cutting tool and cooperable with the guide strip for guiding the cutter through the strip of putty as the power tool is moved longitudinally relative to the guide strip to permit removal of the putty from the window sash.

Preferably, the adapter element has a guide surface for engaging the face of the window sash to limit the depth of penetration of the cutter into the putty. In addition, a peripheral groove is provided adjacent to the guide surface of the adapter element for engaging the guide strip to guide the cutter through the strip of putty as the power tool is moved longitudinally relative to the guide strip. Further, the adapter element is slidably mounted on the shank of the cutting member and permits limited axial movement of the cutting member relative to the adapter element. The amount of axial movement can be adjusted by varying the position of the shank in the chuck of the power tool to adjust the depth of penetration of the cutter into the putty.

The fastening means is preferably embodied as a plurality of manual fasteners which extend through the guide strip into the window sash at spaced locations along the strip. Preferably, the guide strip includes a plurality of holes spaced therealong for receiving the fasteners. The guide strip may be concavo-convex in cross section to provide a convex surface adjacent to the window sash with its opposite longitudinal edges spaced away from the sash to be received in the peripheral groove of the adapter element. This cross-section enables the guide strip to be coiled for storage and shipping while inherently having a force causing it to assume a rectilinear condition where unrestrained. Further, the plurality of holes in the guide strip may be arranged in pairs adjacent to the opposite longitudinal edges of the strip.

A preferred embodiment of the invention comprises a putty removal kit including an elongated, flexible guide strip wrapped in a coil and adapted to be fastened, when uncoiled, to a window sash adjacent to a strip of putty to be removed, and a plurality of fasteners for removably securing the guide strip to the window sash adjacent to the strip of putty. The kit also includes a cutting member having a shank to be received in a chuck of a rotary power tool and a cutter on the shank for engaging the putty, and an adapter sleeve adapted to be rotatably mounted on the shank to permit relative rotation between the adapter sleeve and the cutting member and cooperable with the guide strip for guiding the cutter through the strip of putty as the power tool is moved longitudinally relative to the guide strip to remove the putty from the sash.

The flexible guide strip allows the putty removal apparatus or kit to be universally applied on windows of various sizes and configurations. A single flexible guide strip can be used with different sized windows, even if storm window frames remain in place, without the necessity of removal of the window sash or frame from the building. This universal application is possible because the flexible guide strip provides a variable effective length, in contrast to the fixed length of the rigid guide rails of the prior art. The flexible guide strip can be easily made to conform to curved or rounded windows.

In addition, the fastening arrangement allows the guide strip to be used on the vertical stiles and horizontal muntins of a multiple window as well as on sashes having curved contours. Moreover, since the guide strip is flexible and uses the face of the window sash as a reference for the depth of cut, surface variations do not prevent the cutter from effectively removing the full depth of putty.

Further, the freedom of the adapter to rotate with respect to the cutter minimizes the possibility of scoring the finish on the face of the window sash even though the adapter is in direct engagement with the window sash. Since the adapter is also capable of limited axial movement relative to the cutter, the depth of penetration of the cutter into the putty can be adjusted to remove substantially all of the putty and leave only a thin layer to be manually scraped off.

The accompanying drawing illustrates a preferred embodiment of the invention and together with the description, serves to explain the principles and operation of the invention.

IN THE DRAWING

Figure 2:
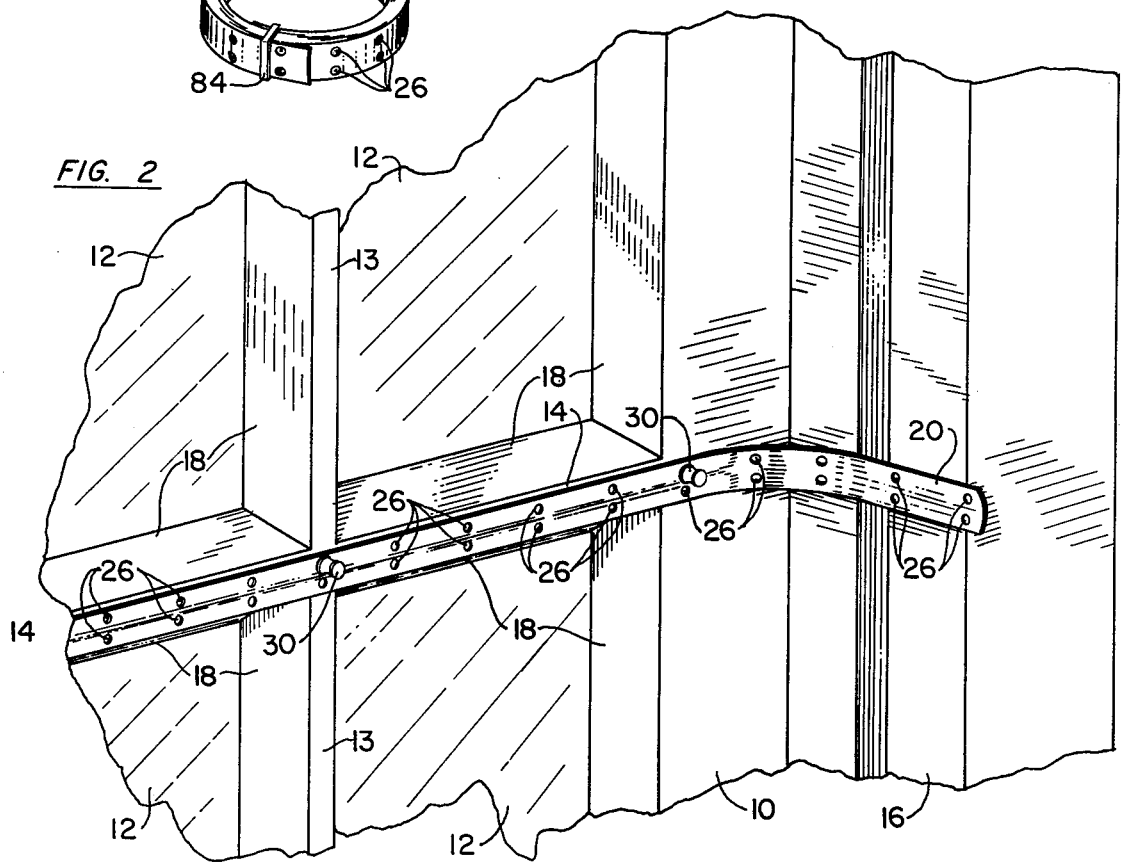
FIG. 2 is a perspective view of a portion of a window sash to which the flexible guide strip is attached by a plurality of manual fasteners.

Referring to FIG. 2, a conventional window from which putty is to be removed comprises a window sash 10 including a plurality of glass panes 12 separated by vertical stiles 13 and horizontal muntins 14. Window sash 10 is surrounded by one or more window frame members 16. Glazing putty is applied in a plurality of strips 18 along the edges of the window sash 10, stiles 13 and muntins 14 to seal the glass panes.

Figure 1:
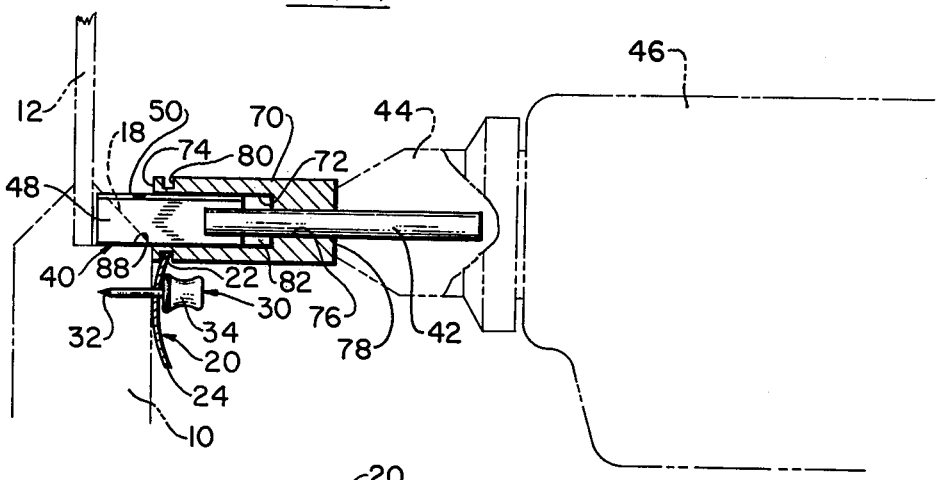
FIG. 1 is an elevation view, partially in section, illustrating a flexible guide strip, manual fastener, cutting member and adapter element which comprise a preferred embodiment of the invention.

The apparatus of the present invention facilitates removal of the strips of glazing putty or retaining strips of other material when necessary to repair the window. Referring to FIGS. 1 and 2, the apparatus includes an elongated, flexible guide strip 20 adapted to be mounted on the window sash adjacent to a strip of putty to be removed. Preferably, guide strip 20 is made of metal and is similar in configuration to metal tape ruler. For example, as shown in FIG. 1, the guide strip may be concavo-convex in cross section to provide a convex surface adjacent to the sash. As a result of its rounded cross section, the guide strip has opposite longitudinal edges 22 and 24 spaced away from the window sash. Guide strip 20 includes a plurality of pin holes 26 (FIG. 2) spaced longitudinally along its length. Pin holes 26 are preferably arranged in pairs adjacent to the opposite longitudinal edges of the guide strip.

The putty removal apparatus also includes means for fastening the guide strip to the window sash adjacent to the strip of putty to be removed. Preferably, as shown in FIGS. 1 and 2, the fastening means is embodied as a plurality of manual fasteners or pins 30, each including a sharp pointed end 32 which extends through the guide strip into the window sash and an enlarged head 34 to allow the pin to be easily handled and to hold the guide strip against the window sash.

The putty removal apparatus also includes a cutting member, generally 40, including a shank 42 which can be received in a chuck 44 of a rotary power tool 46, e.g., a power drill or grinder. The power tool and chuck are shown in phantom lines because these items do not necessarily form part of the inventive combination. In addition, cutting member 40 includes a cutter 48 mounted on shank 42. Preferably, cutter 48 may be a carbide insert which is received in a slot provided at the end of shank 42 and permanently secured to the shank by conventional techniques. Carbide cutter 48 is provided with sharp corners 50 (one shown in FIG. 1) to facilitate removal of the putty upon rotation of cutting member 40 by the rotary power tool.

In addition, the window putty removal apparatus includes an adapter element 70 (FIG. 1) adapted to be rotatably mounted on shank 42 of cutting member 40. Adapter element 70 is generally formed as a cylindrical sleeve having an enlarged axial bore 72 extending inwardly from a front or guide surface 74 of the sleeve and a smaller counterbore 76 extending axially inward from a rear surface 78 of the sleeve and joining enlarged bore 72. Shank 42 of cutter member 40 is rotatably received in counterbore 76 of adapter sleeve 70, and sufficient clearance is provided to allow sleeve 70 and shank 42 to freely rotate with respect to each other. Similarly, carbide cutter 48 is rotatably received within enlarged bore 72 and sufficient clearance is provided to allow the cutter to freely rotate relative to the adapter sleeve.

Adapter sleeve 70 is cooperable with guide strip 20 for guiding cutter 48 through the strip of putty as the power tool is moved longitudinally relative to the guide strip. As shown in FIG. 1, adapter sleeve 70 is provided with a peripheral groove 80 formed in its outer cylindrical surface and located adjacent to front or guide surface 70. Groove 80 is spaced axially away from guide surface 74 for engagement with guide strip 20. Because of the rounded cross section of guide strip 20, its upper edge 22 is spaced away from the face of window sash 10 by an amount sufficient to allow edge 22 to be received within peripheral groove 80 of the adapter sleeve. Front surface 74 of the adapter element serves as a guide surface for engaging the face of the window sash to limit the depth of penetration of cutter 48 into the strip of putty.

As shown in FIG. 1, there is a clearance 82 provided in main bore 72 to allow adapter sleeve 70 a limited amount of axial movement relative to cutting member 40. The amount of axial movement is adjustable and determined by the position at which shank 42 is inserted into rotary chuck 44. When guide surface 74 of adapter sleeve 70 is pressed against the face of window sash 10, cutting member 40 slides forwardly relative to the adapter sleeve until chuck 44 engages rear surface 78 of the adapter sleeve. Cutter 48 extends forwardly from front surface 74 of the adapter sleeve and penetrates into layer 18 of putty. Preferably, as shown in FIG. 1, shank 42 is adjusted in chuck 44 to a position where cutter 48 protrudes from adapter sleeve 70 to a position just short of glass pane 12 to protect the glass against breakage.

Figure 3:
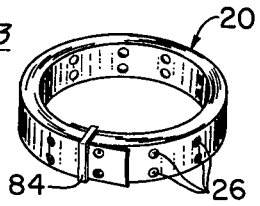
FIG. 3 is a perspective view illustrating the flexible guide strip wrapped into a coil as part of a putty removal kit embodying the principles of the invention.

The invention may be preferably embodied as a window putty removal kit conveniently packaged and ready for use with a hand-held power drill or grinder. Referring to FIG. 3, when the putty removal apparatus is packaged as a kit, guide strip 20 is wrapped in a coil and secured by a strap 84 or other suitable fastener. The kit also includes cutting member 40 and adapter element 70 (shown in FIG. 1). In addition, a set of pins 30 (FIG. 2) is packaged in the kit.

When it is desired to use the putty removal apparatus, adapter sleeve 70 is slipped over shank 42 of cutting member 40, as shown in FIG. 1, and shank 42 is secured in the jaws of rotary chuck 44. Cutter member 40 is adjusted in chuck 44 so that, with front or guide surface 74 of sleeve 70 engaging the window sash and rear surface 78 abutting against the chuck, a small clearance, e.g., 1/32–1/16 inch, is provided between cutter 48 and glass pane 12.

Guide strip 20 is uncoiled and fastened to window sash 10, vertical stiles 13 or horizontal muntins 14 adjacent to a strip 18 of putty desired to be removed. Pins 30 are manually inserted through selected holes 26 in guide strip 20 and pushed into the sash, stiles or muntins to secure the guide strip. As shown in FIG. 1, because of the rounded cross section of guide strip 20, edges 22 and 24 are spaced away from the face of the window sash.

Next, adapter sleeve 70 is brought into engagement with guide strip 20 to locate edge 22 of the guide strip in peripheral groove 80 of the adapter sleeve. Preferably, as shown in FIG. 1, guide strip 20 is situated on window sash 10 such that the bottom of axial bore 72 is aligned with a ledge 88 of the window sash to avoid gouging or damaging the sash when cutter 48 is rotated. When power tool 46 is activated to rotate cutting member 48 and moved longitudinally relative to guide strip 20, cutter 48 is guided through strip 18 of putty to be removed by adapter sleeve 70 and the guide strip. The strip of putty is removed, except for a thin layer adjacent to the glass pane. This thin residual layer is easily scraped off manually by using a putty knife.

The putty removal apparatus of the present invention can be advantageously utilized with various window sizes and shapes without removal of the window sash from the frame. Flexible guide strip 20 can be easily adapted to different window sizes and shapes. As shown in FIG. 2, even if the length of guide strip 20 exceeds the window dimensions, the unnecessary portion of the flexible guide strip can be bent away from the window sash, e.g., around window frame member 16. Thus, although the guide strip itself is fixed in length, it provides a variable effective length to accommodate different window sizes. Moreover, the flexibility of guide strip 20 allows the putty removal apparatus to be readily used with curved or round windows.

In addition, since cutting member 40 is freely rotatable relative to adapter sleeve 70, the likelihood of damage to the face of the window sash is substantially reduced. Cutter 48 can rotate at relatively high speed to remove putty strip 18 while adapter sleeve 70 remains stationary or rotates quite slowly as the power tool is moved longitudinally along guide strip 20.

It will be understood by persons skilled in the art that the present invention is not necessarily limited to removal of putty from a window sash. For example, in the case of a garage door, it is customary for the window glass to be completely encased in wood. The present apparatus can be used with such windows to remove the wood retaining strips at the edge of the window glass in similar fashion to the putty removal operation described above.

The present invention is not limited to the specific details shown and described, and modifications may be made in the window putty removal apparatus without departing from the principles of the invention.

What is claimed is:

1. In apparatus suited to be driven by a portable power tool having a chuck and to remove putty from a window sash without removing the window sash from its frame comprising an elongated guide strip, means to removably mount the guide strip on the window sash adjacent a strip of putty to be removed, a rotary cutter having a cutting head and a shank, and adapter mounted on the shank and having an axial bore to provide a cylindrical sleeve extending axially over a portion of the cutting head, the improvement wherein the guide strip is coilable and of concavo-convex cross-section to provide a guide of variable effective length, the adapter is journaled on the shank of the rotary cutter for rotation and limited axial movement relative thereto, said adapter being engageable with the chuck to fix the maximum distance the cutting head extends beyond the sleeve thereby to fix the depth of cut, and the sleeve has a reduced outer periphery adjacent its free end to engage the guide strip to prevent contact between the cutter and the guide strip as the cutter moves laterally along the guide strip to remove the putty.

* * * * *